United States Patent [19]

Ochiai et al.

[11] Patent Number: 4,624,589

[45] Date of Patent: Nov. 25, 1986

[54] DOT PRINTER HEAD

[75] Inventors: Kuniaki Ochiai; Masami Horii; Shigeo Komakine; Shinzi Tsuyuki, all of Shizuoka, Japan

[73] Assignee: Tokyo Electric Co., Ltd., Tokyo, Japan

[21] Appl. No.: 712,185

[22] Filed: Mar. 15, 1985

[30] Foreign Application Priority Data

Mar. 15, 1984 [JP] Japan ..... 59-50046

[51] Int. Cl.[4] ..... B41J 3/04

[52] U.S. Cl. ..... 400/124; 101/93.05

[58] Field of Search ..... 400/124, 124 IW, 124 TC, 400/124 VI, 124 WD, 157.2; 101/93.05

[56] References Cited

U.S. PATENT DOCUMENTS

| | | | |
|---|---|---|---|
| 4,230,038 | 10/1980 | Hebert | 101/93.05 |
| 4,230,412 | 10/1980 | Hebert | 400/124 |
| 4,453,840 | 6/1984 | Hodne | 400/124 |

FOREIGN PATENT DOCUMENTS

| | | | |
|---|---|---|---|
| 500160 | 3/1980 | Japan . | |
| 87576 | 7/1980 | Japan | 400/124 |
| 154874 | 12/1981 | Japan | 400/124 |
| 8167 | 1/1982 | Japan | 400/124 |

*Primary Examiner*—Charles Pearson

*Attorney, Agent, or Firm*—Oblon, Fisher, Spivak, McClelland & Maier

[57] ABSTRACT

A dot printer head in which each radially directed armature is urged to pivot about its primary fulcrum in the return direction by a metallic return spring and is urged to pivot in the opposite angular direction by a metallic holding spring. The metallic return springs and metallic holding springs are sized and positioned so that the metallic holding springs exert a torque urging the radially directed armature to pivot in the actuating direction that is lower than the torque urging the armatures to pivot in the return direction.

3 Claims, 3 Drawing Figures

DOT PRINTER HEAD

SUMMARY OF THE INVENTION

The present invention resides in a dot printer head of the type wherein an armature is supported at a position inside of a core and is urged in a return direction by a return spring to a position in which an inner end thereof is abutted with a stopper to thus define a gap between the armature and the core. The dot printer head is constituted such that the armature is held at a portion thereof outside of a fulcrum by a holding spring so as to effectively prevent floating of the armature adjacent the core about an abutting portion between the inner end of the armature and the stopper. Particularly when the armature is held by a holding spring having a torque lower than the torque of the returning spring, the torque of the holding spring can be increased to increase the floating preventing action of the armature. Abrasion of the fulcrum is thus prevented. Moreover, the characteristics of the holding spring are not influenced by changes of temperature, so fluctuations in the load on the armature are eliminated. This assures uniform printing, resulting in a moderation of the required accuracy of the parts and a reduction of production costs.

FIELD OF THE INVENTION

This invention relates to a dot printer head, and more particularly to a dot printer head wherein an armature connected to a needle is electromagnetically actuated to reciprocate the needle.

OBJECTS OF THE INVENTION

It is a first object of the present invention to provide a dot printer head wherein floating of the armatures upon operation is prevented.

It is a second object of the invention to provide a dot printer head wherein abrasion of the fulcrums at which the armatures are supported is prevented.

It is a third object of the invention to provide a dot printer head wherein fluctuations of the load on the armatures can be prevented.

It is a fourth object of the invention to stabilize printing by a dot printer head which attains the objects of the invention described above.

It is a fifth object of the invention to provide a dot printer head having a structure which can be easily produced.

Other objects of the invention will become apparent from the following description.

PRIOR ART

Figure 1:
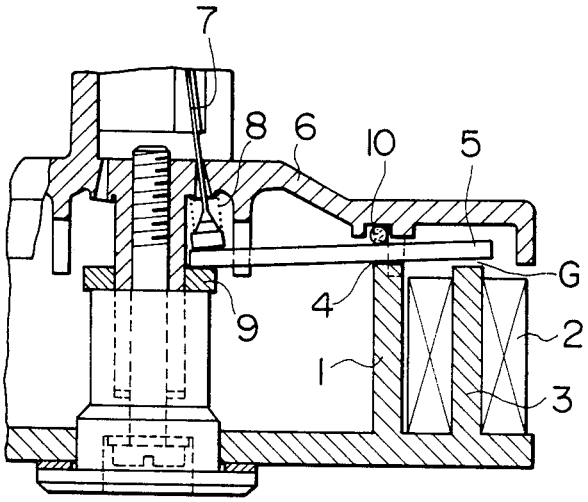
FIG. 1 is a horizontal sectional view showing a conventional dot printer head.

Conventionally, there are two types of dot printer heads which employ a hinge type magnet. In one of the two types, the fulcrum for each armature is located outside of the associuated core. In the other type, the fulcrum for each armature is located inside of the associated core. The latter has an advantage in that it has a lower moment of inertia than the former. Accordingly, the latter is well adapted for high speed printing, consumes less power, and can be reduced in size. A typical example (refer to Japanese Application Pat. No. 55-500160) of such conventional arrangements wherein the fulcrum for each armature is located inside of the associated core is illustrated in FIG. 1. Referring to FIG. 1, a plurality of cores 3 which each hold a coil 2 are located outside of a common yoke 1. Armatures 5 are supported at fulcra 4 provided by an edge of an inner circumference of the yoke 1. The needle 7 is held by a common guide holder 6 and is urged in its return direction together with the associated armature 5 by a needle spring 8. The needle spring 8 urges the armature 5 to a position in which it abuts a common stop 9 to thus define a gap G between the armature 5 and the core 3. A common fulcrum holder 10 made of rubber for holding down the armatures 5 is provided on the guide holder 6.

Accordingly, a coil 2 may be energized to attract the associated armature 5 to the associated core 3 to effect printing, and then the associated needle 7 and the associated armature 5 will be returned by the associated needle spring 8. When the armature 5 is returned to its initial position, the fulcrum holder 10 prevents the outer portion of the armature 5 from oscillating about the fulcrum 4. Such oscillations are referred to herein as "floating". However, since there are variations in the width of the gap in which the fulcrum holder 10 and the armatures 5 are received (that is, in the distance between the yoke 1 and the guide holder 6), resulting in variations the resiliency of the fulcrum holder 10, the forces exerted by the fulcrum holder 10 which holds the armatures 5 in their rest positions cannot be constant. In the forces of the fulcrum holder 10 are too low, when the armatures 5 return, they will float from the yoke 1 and will thus repeat collisions with the yoke 1 so that much time will be taken until they come into stabilized or stationary conditions. Moreover, floating causes the fulcra 4 to become worn. On the other hand, if the forces of the fulcrum holder 10 are too high, the loads against the printing operations of the armatures 5 are increased, thereby reducing the printing forces.

It is not easy to make uniform the distance between the yoke 1 and the guide holder 6. Moreover, particularly when the fulcrum holder 10 is made of a rubber material, it is difficult to make its resiliency uniform. Besides, as the temperature changes, the resiliency of the fulcrum holder 10 will vary so that, when the temperature is low, loads to the armatures 5 will increase and hence only poor printing results can be obtained until the temperature rises.

EMBODIMENT OF THE INVENTION

Figure 2:
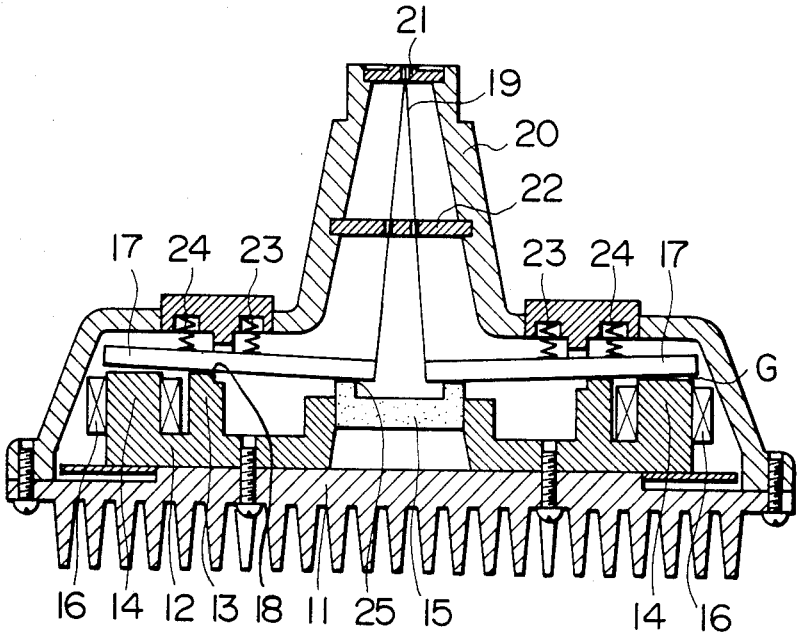
FIG. 2 is a horizontal sectional view illustrating an embodiment of the present invention.
Figure 3:
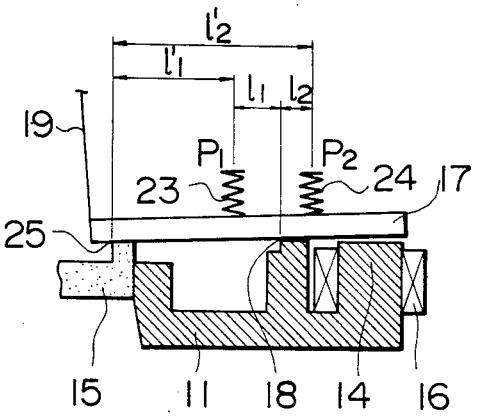
FIG. 3 is a partial horizontal sectional view illustrating actions of a return spring and a holding spring.

An embodiment of the present invention will be described with reference to FIGS. 2 and 3. An annular bank 13 and a plurality of cores 14 are formed on a yoke 12 which is screwed to an inner face of a heat radiating cover 11. A stopper 15 is secured internally of the yoke 12, and a coil 16 is mounted on each of the cores 14. A plurality of armatures 17 are held for pivotal motion about fulcra 18 which are provided by the bank 13 contacted by the armatures 17. A needle 19 is secured to an inner end of each of the armatures 17 and extends for sliding motion through needle guides 21 and 22, both of which are secured to a guide frame 20. A return spring 23 and a holding spring 24 for urging each of the armatures 17 toward the yoke 12 are held by the guide frame 20. The force P1 of the return spring 23 acts on a point of the armature 17 spaced inwardly from its fulcrum 18 by a distance $l_1$ and spaced by a distance $l_1'$ from the stopper 15. Meanwhile, the force P2 of the holding spring 24 acts on a point of the armature 17 spaced by a distance $l_2$ from the fulcrum 18 toward the core 14 and spaced by a distance $l_2'$ from the stopper 15. The torque $P1l_1$ exerted by the return spring 23 is greater than the torque $P2l_2$ exerted by the holding spring 24.

In the dot printer head of the construction described above, if a coil 16 is energized, then the associated armature 17 is attracted to the associated core 14 and pivoted about its fulcrum 18 to cause the associated needle 19 to move into abutment with a platen to effect printing. Then, directly after the coil 16 is energized, the armature 17 is returned by a torque corresponding to a difference between $P1l_1$ and $P2l_2$ to its initial position, in which it abuts against the stopper 15 with a gap G left between the armature 17 and the core 14. Although at the instant of return a moment acts upon the armature 17 tending to float the armature 17 from the yoke 12 about an abutting point 25 between the armature 17 and the stopper 15, a moment equal to $P1l_1'+P2l_2'$ acts upon the armature 17 against the former moment. Hence the armature 17 is rapidly stabilized without floating from the yoke 12. Particularly since the armature 17 can be attracted to the core 14 by a small magnetic force even if $P2l_2$ is increased (so long as the condition $P1l_1>P2l_2$ is met), the moment $P2l_2'$ holding the armature 17 against the yoke 12 can be increased by increasing the distance $l_2'$. Accordingly, positiveness of the action to minimize floating of the armature 17 from the yoke 12 can be increased. As a result, the fulcrum 18 is less worn by collisions and can endure a long term of use. Besides, the characteristics of the springs 23 and 24 (which may be made of a steel material) are little influenced by changes of temperature, and, if the spring constants are made low, the characteristics of the springs 23 and 24 are not influenced by variations in distance between the yoke 12 and the guide frame 20. Accordingly, operation of the armatures 17 can be stabilized so that uniform print density can be attained, and accuracy of dimensions of parts can be moderated to facilitate production of the same and to reduce their production costs. It is to be noted that the return spring 23 may be replaced by a spring for returning the needle 19 (such as needle spring 8).

Since the present invention has a construction as described above, the force of the holding spring acts on a point of an armature far remote from the secondary fulcrum on the stopper, which is positioned to abut with the inner ends of the armatures to define the return positions of the armatures so that floatings of the armatures from the primary fulcrum upon returning to their return positions can be prevented or minimized very effectively. Particularly when the force of the holding spring is lower than the returning torque of the armature, it can be increased together with the force of the return spring, thereby increasing the positiveness of the action to prevent or minimize floating of the armature. Accordingly, abrasion of fulcra or the like due to collisions can be prevented or minimized. Moreover, since the characteristics of the holding springs are not significantly influenced by changes of temperature, variations or fluctuations of loads to the armatures can be eliminated or minimized, and hence printing of uniform density can be attained. In addition, the characteristics of the holding springs which can have large deflections are not influenced very much by accuracy in dimension of other parts. Accordingly, the present invention has an additional effect that production of a dot printer head can be facilitated, resulting in reduction of production cost.

The invention claimed is:

1. A dot printer head comprising:

(a) a yoke;

(b) an annular bank mounted on said yoke;

(c) a plurality of cores magnetically coupled to said yoke, said plurality of cores forming an annular array around and externally of said annular bank;

(d) a plurality of coils, each one of said plurality of coils being mounted on a corresponding one of said plurality of cores;

(e) a plurality of radially oriented armatures, each one of said plurality of radially oriented armatures being pivoted about a corresponding primary fulcrum on said annular bank;

(f) a plurality of printing needles, each one of said plurality of printing needles being operatively associated with a corresponding one of said plurality of radially oriented armatures;

(g) a stopper positioned to support the radially inner end of each one of said plurality of radially oriented armatures when in its rest position, each one of said plurality of radially oriented armatures being pivotal about a corresponding secondary fulcrum on said stopper;

(h) a plurality of metallic return springs, each one of said plurality of metallic return springs urging an associated one of said plurality of radially oriented armatures to pivot about its primary fulcrum in the return direction and to pivot about its secondary fulcrum in the opposite angular direction; and (i) a plurality of metallic holding springs, each one of said plurality of metallic holding springs bearing against an associated one of said plurality of radially oriented armatures radially outwardly of its primary fulcrum and urging said associated one of said plurality of radially oriented armatures to pivot about its primary fulcrum in the angular direction opposite to the angular direction in which the associated one of said metallic return springs urges it to pivot and to pivot about its secondary fulcrum in the same angular direction as the angular direction in which the associated one of said plurality of metallic return springs urges it to pivot;

(j) said plurality of metallic return springs and said plurality of metallic holding springs being sized and positioned so that each one of said plurality of metallic holding springs exerts a torque urging the associated one of said plurality of radially directed armatures to pivot abouts its primary fulcrum in the actuating direction that is lower than the torque exerted by the associated one of said metallic return springs urging the associated one of said plurality of radially directed armatures to pivot in the return direction.

2. A dot printer as recited in claim 1 wherein each one of said plurality of metallic return springs bears against an associated one of said plurality of radially directed armatures between its secondary fulcrum on said stopper and its primary fulcrum on said annular bank.

3. A dot printer as recited in claim 1 wherein each one of said plurality of metallic return springs bears against an associated one of said plurality of printing needles.

* * * * *